US005368297A

United States Patent [19]

Liu

[11] Patent Number: 5,368,297

[45] Date of Patent: Nov. 29, 1994

[54] RACKET FRAME AND PROTECTIVE PACKING DEVICE ARRANGEMENT

[76] Inventor: Leueis Liu, 9F-3, No. 218, Kuo Kuang Rd., Taichung, Taiwan, Prov. of China

[21] Appl. No.: 158,515

[22] Filed: Nov. 29, 1993

[51] Int. Cl.[5] ..... A63B 49/00

[52] U.S. Cl. ..... 273/73 D

[58] Field of Search ..... 273/73 R, 73 C, 73 D

[56] References Cited

U.S. PATENT DOCUMENTS

| | | | |
|---|---|---|---|
| 4,314,699 | 2/1982 | Bayer et al. | 273/73 C X |
| 5,029,859 | 7/1991 | Davis | 273/73 C X |
| 5,102,132 | 4/1992 | Chen | 273/73 R |

FOREIGN PATENT DOCUMENTS

| | | | |
|---|---|---|---|
| 2582528 | 12/1986 | France | 273/73 C |

*Primary Examiner*—Vincent Millin
*Assistant Examiner*—Raleigh W. Chiu
*Attorney, Agent, or Firm*—Morton J. Rosenberg; David I. Klein

[57] ABSTRACT

A racket frame and protective packing device arrangement including an open racket frame which has a longitudinal recessed portion on an outside wall thereof, a plurality of string holes spaced on the recessed portion, and a plurality of elongated grooves connected between the string holes at an outer side; and a protective packing strip fitted into the longitudinal recessed portion which has a plurality of double open-end string tubes respectively inserted into the string holes for inserting a catgut string to set up a striking surface in the open racket frame, and a plurality of ribs longitudinally aligned and respectively fitted into the elongated grooves.

5 Claims, 6 Drawing Sheets

RACKET FRAME AND PROTECTIVE PACKING DEVICE ARRANGEMENT

BACKGROUND OF THE INVENTION

The present invention relates to a racket frame and protective packing device arrangement which protects and catgut string and greatly improves the strength of the frame of the racket.

Prior art protective elements 2 which are fastened to the frame 1 for inserting the catgut string 3, as shown in FIG. 1, are to protect the catgut string and prevent it from being damaged by the sharp orifices of the string holes 21 on the frame. In order to facilitate the insertion of the catgut string 3, chamfered edges are made on the turning corners of the protective elements 2. Therefore, the protective elements tear easily at the chamfered edges. When the protective elements are damaged, the catgut string becomes not protected.

SUMMARY OF THE INVENTION

The present invention has been accomplished to provide a racket frame and protective packing device arrangement which eliminates the aforesaid problem. According to one embodiment of the present invention, the racket frame and protective packing device arrangement comprises an open racket frame and a protective packing strip. The open racket frame comprises a longitudinal recessed portion on an outside wall thereof, a plurality of string holes spaced on the recessed portion, and a plurality of elongated grooves connected between the string holes at an outer side. The protective packing strip fits into the longitudinal recessed portion on the open racket frame, and comprises a plurality of double open-end string tubes respectively inserted into the string holes for inserting a catgut string to set up a striking surface in the open racket frame, and a plurality of ribs longitudinally aligned and respectively fitted into the elongated grooves on the open racket frame. As the catgut string is supported on the ribs of the protective packing strip, it does not wear easily. Further, the arrangement of the longitudinal grooves greatly improve the structural strength of the open racket frame.

DETAILED DESCRIPTION OF THE PREFERRED EMBODIMENTS

Figure 1:
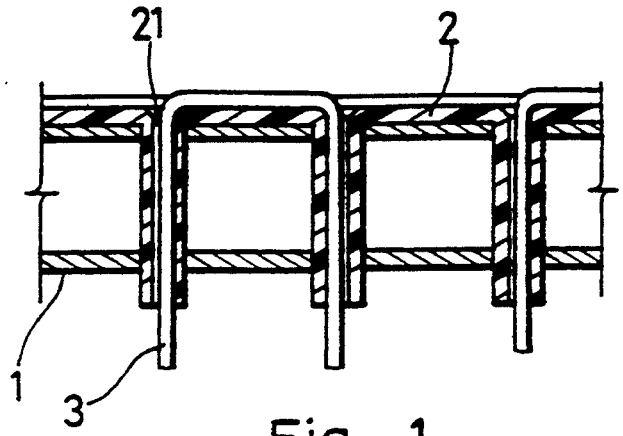
Fig. 1 PRIOR ART
FIG. 1 is a sectional view showing conventional protective elements fastened to the racket frame to protect the catgut string.
Figure 5:
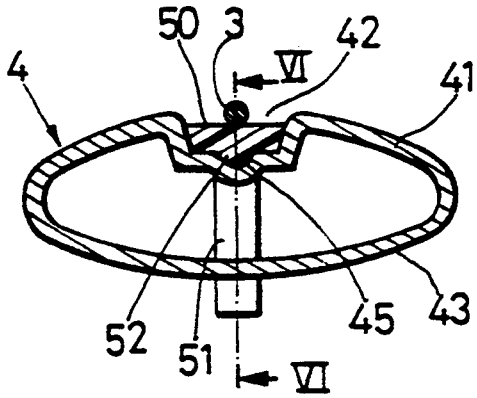
FIG. 5 is a partial assembly view in section of the embodiment of FIG. 2.
Figure 6:
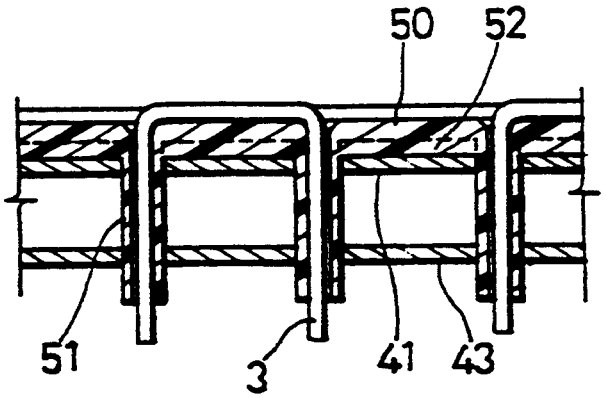
FIG. 6 is a cross section taken along line VI—VI of FIG. 5.
Figures 2, 3, 4:
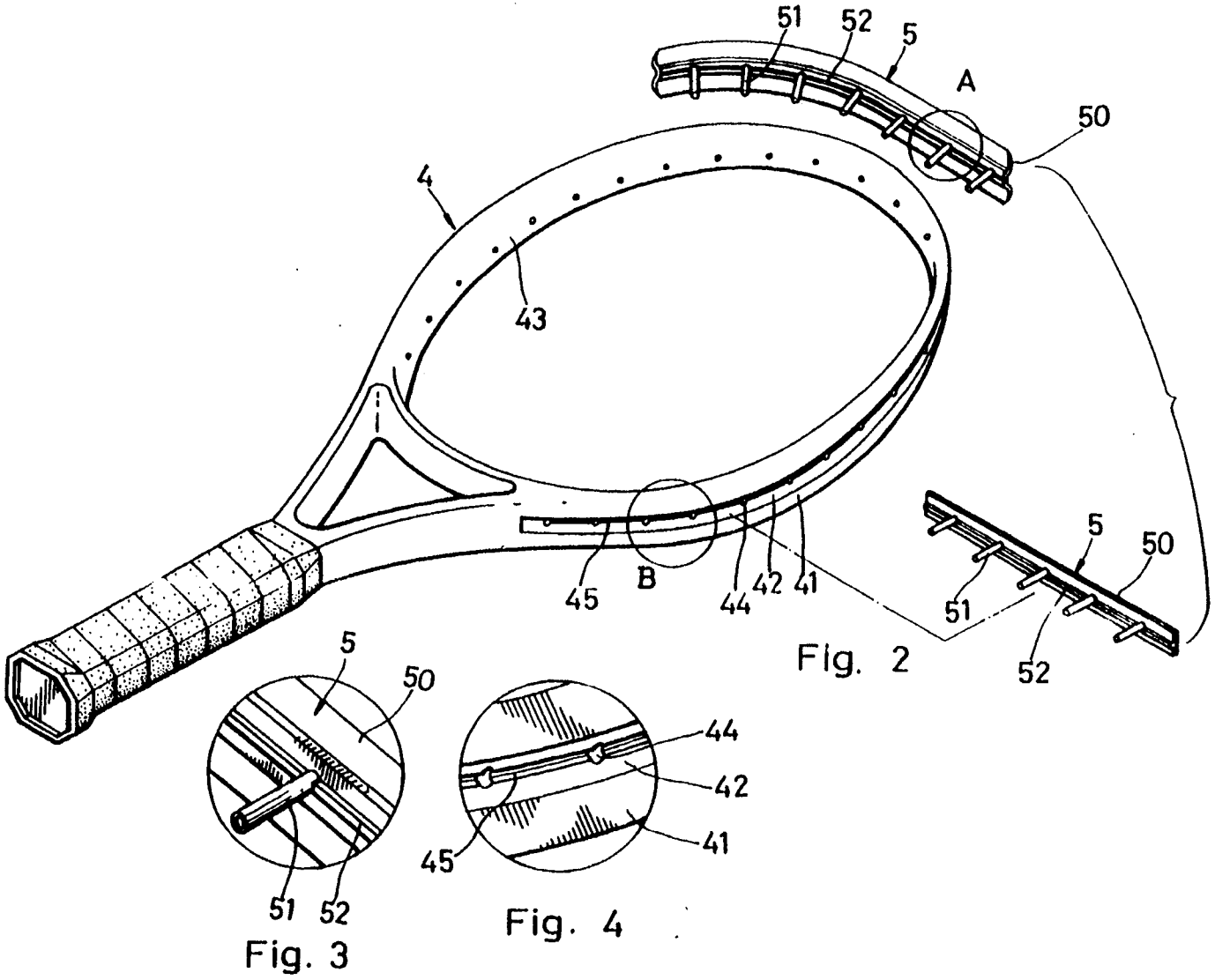
FIG. 2 is an exploded view of a first embodiment of the present invention.
FIG. 3 is an enlarged view of part A of FIG. 2.
FIG. 4 is an enlarged view of part B of FIG. 2.
Figures 7, 8, 9:
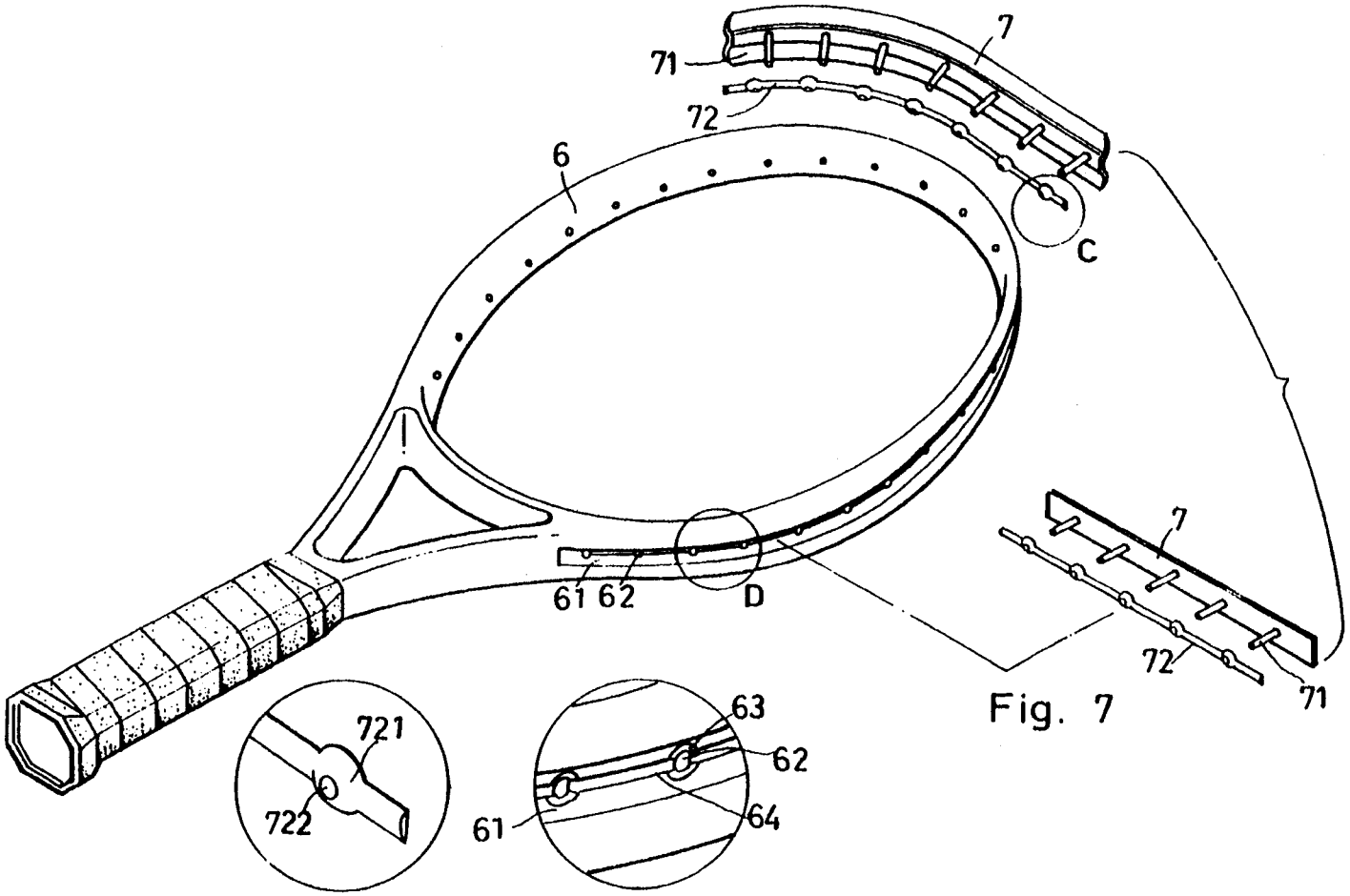
FIG. 7 is an exploded view of a second embodiment of the present invention.
FIG. 8 is an enlarged view of part C of FIG. 7.
FIG. 9 is an enlarged view of part D of FIG. 7.
Figure 12:
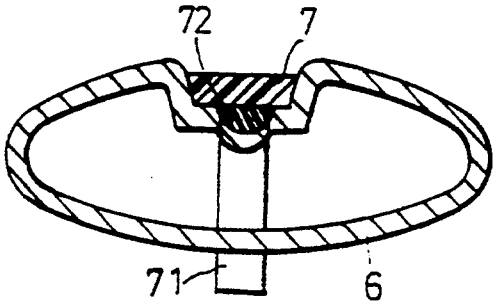
FIG. 12 is a cross section taken along line XII—XII of FIG. 10.
Figure 11:
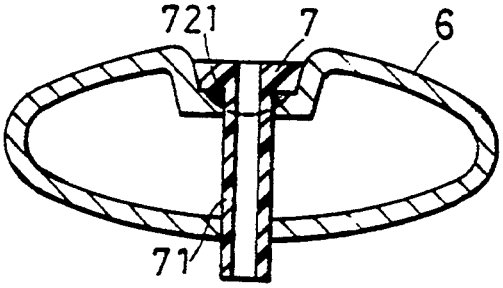
FIG. 11 is a cross section taken along line XI—XI of FIG. 10.
Figure 10:
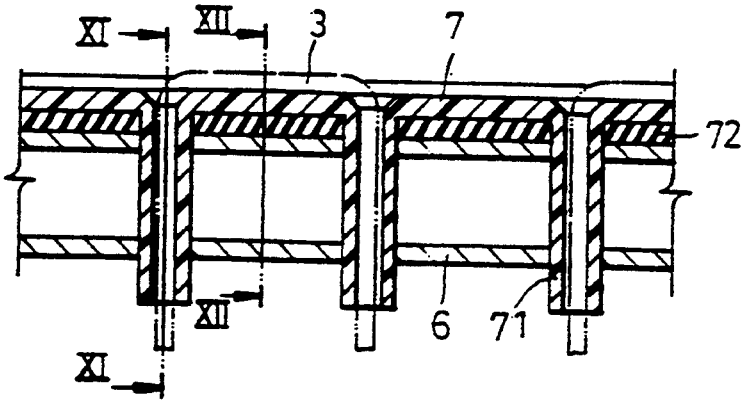
FIG. 10 is a partial assembly view in section of the embodiment of FIG. 7.

Referring to FIGS. 2, 3, 4, 5, and 6, the racket frame, referenced by 4, comprises a longitudinal recessed portion 42 on the outside wall 41 thereof in the middle along the length thereof, a plurality of string holes 44 spaced on the recessed portion 42 through the inside wall 43 thereof, and a plurality of elongated grooves 45 made on the recessed portion 42 in the middle along the longitudinal center line thereof and connected between the string holes 44. The protective packing device, referenced by 5, comprises an elongated packing strip 50, a plurality of double open-end string tubes 51 perpendicularly extended from the packing strip 50 at the same side, and a plurality of longitudinal ribs 52 raised from the packing strip 50 along the longitudinal center line thereof and respectively connected between the string tubes 51. The protective packing member 5 is fastened to the frame 4 by inserting the string tubes 51 into the string holes 44 on the frame 4 permitting the longitudinal ribs 52 to be respectively engaged into the longitudinal grooves 45 and the packing strip 50 to be fitted into the longitudinal recessed portion 42. When assembled, a catgut string 3 is inserted through the string tubes 51 to set up a striking surface in the frame 4. Because the longitudinal ribs 52 of the protective packing member 5 are respectively engaged into the longitudinal grooves 45 where the catgut string 3 passes, the pressure from the catgut string 3 is acted on the longitudinal ribs 52, and therefore the catgut string 3 will not be damaged easily. When the catgut string 3 is turned from one direction to another, it is supported by a respective longitudinal rib 52, and therefore the catgut string 3 does not deform. In addition to the aforesaid advantages, the arrangement of the longitudinal grooves 45 on the longitudinal recessed portion 42 forms a rib on the outside wall 41 of the frame 4 to reinforce the structural strength of the frame 4.

Referring to FIGS. 7, 8, 9, 10, 11, and 12, the racket frame, referenced by 6, comprises a longitudinal recessed portion 61 on the outside wall thereof in the middle along the length thereof, and a plurality of string holes 62 spaced on the recessed portion 61, and a plurality of elongated grooves 64 made on the recessed portion 61 in the middle along the longitudinal center line thereof and respectively connected between the string holes 62, wherein each string hole 62 has an expanded orifice 63 at an outer side. The protective packing device comprises an elongated packing strip 7 having a plurality of double open-end string tubes 71 perpendicularly extended from one side thereof, and a strip of rubber 72. The strip of rubber 72 comprises a plurality of expanded portions 721 spaced from one another at equal pitch corresponding to the string tubes 71 on the elongated packing strip 7, each expanded portion 721 having a center through hole 722 in diameter approximately equal to the outer diameter of the string tubes 71. During the assembly process, the strip of rubber 72 is engaged into the longitudinal grooves 64 permitting the expanded portions 721 to be respectively fitted into the expanded orifice 63 on either string hole 62, then the string tubes 71 of the packing strip 7 are respectively inserted into the center through holes 722 on the expanded portions 721 of the strip of rubber 72 and the string holes 62 on the frame 6.

Figure 14:
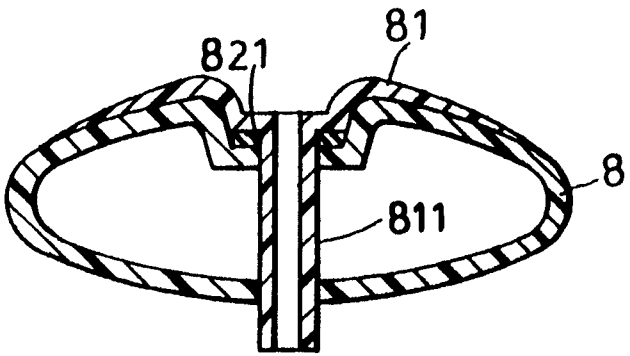
FIG. 14 is another cross section of the third embodiment of the present invention.
Figure 13:
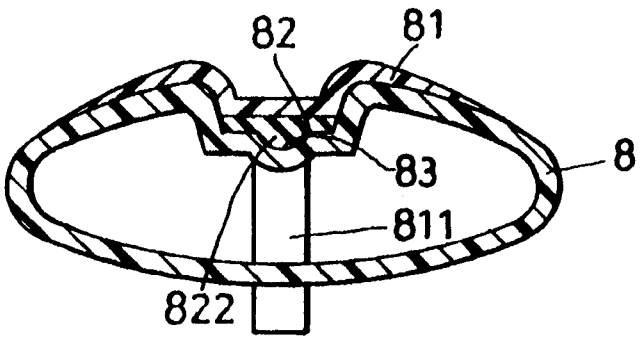
FIG. 13 is a cross section of a third embodiment of the present invention.

Referring to FIGS. 13 and 14, a flat, elongated rubber element 82 is retained between the frame, referenced by 8, and the protective packing device, referenced by 81. The rubber element 82 comprises holes 821, through which the string tubes 811 of the protective packing device 81 insert, and a plurality of longitudinal ribs 822 connected between the holes 821 and respectively engaged into respective longitudinal grooves 83 on the frame 8. Because the longitudinal ribs 822 of the rubber element 82 are respectively engaged into the longitudinal grooves 83 on the frame 8 and retained between the frame 8 and the protective packing device 81, the string tubes 811 are flexibly supported, and therefore the catgut string will not be damaged easily. Furthermore, the rubber element 82 can absorb shocks transmitted from the catgut string.

Figure 16:
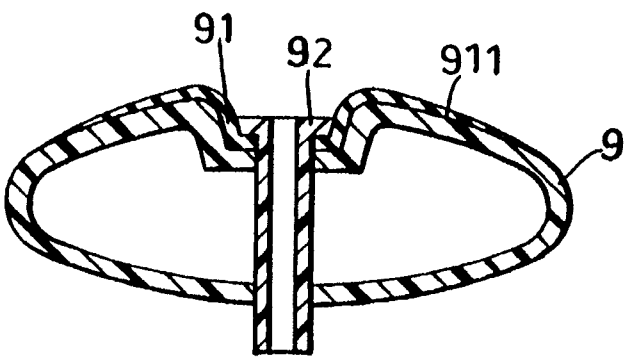
FIG. 16 is another cross section of the fourth embodiment of the present invention.
Figure 15:
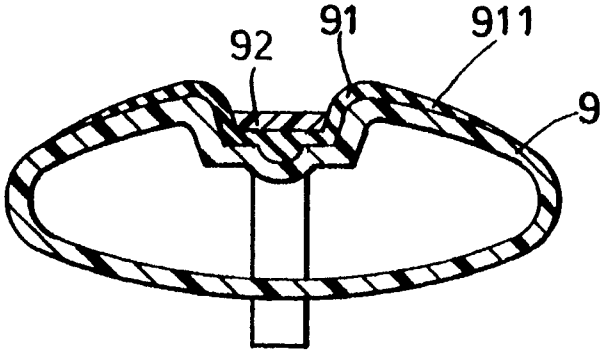
FIG. 15 is a cross section of a fourth embodiment of the present invention.

Referring to FIGS. 15 and 16, the rubber element 91 which is retained between the frame 9 and the protective packing device 92 has two wing portions 911 at two opposite sides along the length thereof.

What is claimed is:

1. A structurally reinforced racket frame having cross-directed string members to provide a ball striking force, comprising:

(a) an open racket frame having a plurality of spaced apart string holes passing therethrough and defining an extended trough formed within an external wall thereof, said extended trough having an extended frame groove formed in a lower surface thereof in open communication with said consecutively spaced apart string holes; and, (b) protective packing means for protecting said string members, said protective packing means being mounted within said extended trough including an extended packing strip member contoured for mating engagement with said extended trough and a plurality of tubular members extending substantially perpendicular to said extended packing strip member being spaced apart each from the other for alignment with and insert into said string holes, each of said tubular members having a through opening for passage therethrough of said string members, said packing strip member having extended rib members on a lower surface thereof for mating engagement with said frame groove extending throughout an extension length between consecutively spaced apart string holes.

2. The structurally reinforced racket frame as recited in claim 1 wherein said protective packing means packing strip member ribs are integrally formed on said packing strip member and fixedly coupled to consecutively spaced tubular members.

3. The structurally reinforced racket frame as recited in claim 1 where said rib members are integrally molded on an elongated rubber strip member.

4. The structurally reinforced racket frame as recited in claim 3 where said elongated rubber strip member includes expanded arcuately contoured sections having respective through openings for alignment with said racket frame string holes, said rib members being molded to consecutively spaced arcuately contoured sections on opposing ends thereof, each of said string holes having an expanded orifice formed within said racket frame external wall for matingly receiving said expanded arcuately contoured sections of said rubber strip member.

5. The structurally reinforced racket frame as recited in claim 4 where said elongated rubber strip member includes a pair of opposing wing sections formed on laterally opposing sides of said rubber strip member.

* * * * *